United States Patent [19]

DeWalch et al.

[11] Patent Number: 4,742,703

[45] Date of Patent: May 10, 1988

[54] CYLINDER LOCK AND KEY WITH ROTATING ELEMENTS

[76] Inventors: Norman B. DeWalch; Donald P. DeWalch, both of 1213 West Loop North, Suite 180, Houston, Tex. 77055

[21] Appl. No.: 839,283

[22] Filed: Mar. 17, 1986

[30] Foreign Application Priority Data

Apr. 4, 1985 [GB] United Kingdom ..... 85-08961

[51] Int. Cl.[4] ..... E05B 29/02; E05B 19/08

[52] U.S. Cl. ..... 70/366; 70/399

[58] Field of Search ..... 70/365, 366, 395, 399, 70/417, DIG. 62

[56] References Cited

U.S. PATENT DOCUMENTS

| | | | |
|---|---|---|---|
| 87,518 | 3/1869 | Smith | 70/399 |
| 1,115,040 | 10/1914 | Voight | 70/DIG. 62 |
| 1,446,760 | 2/1923 | Miller . | |
| 2,301,755 | 11/1942 | Seiffert | 70/355 |
| 2,356,891 | 8/1944 | Seiffert | 70/411 |
| 3,410,123 | 11/1968 | Jacob | 70/471 |
| 3,623,345 | 11/1971 | Solitanner | 70/417 |
| 3,668,909 | 6/1972 | Roberts | 70/411 |
| 3,714,802 | 2/1973 | Morse | 70/34 |
| 3,848,442 | 11/1974 | Mertanen | 70/366 |
| 4,008,588 | 2/1977 | Miller | 70/366 |
| 4,062,211 | 12/1977 | Miller | 70/366 |
| 4,083,212 | 4/1978 | Proefrock | 70/366 |
| 4,211,097 | 7/1980 | Martikainen | 70/373 |
| 4,267,717 | 5/1981 | Martikanen | 70/366 |
| 4,320,640 | 3/1982 | Martikainen | 70/366 |
| 4,370,875 | 2/1983 | Piiroinen | 70/422 |
| 4,415,190 | 11/1983 | Finck, Jr. | 292/256.6 |
| 4,418,555 | 12/1983 | Uyeda | 70/366 |

FOREIGN PATENT DOCUMENTS

| | | |
|---|---|---|
| 1273119 | 5/1972 | United Kingdom . |
| 1419722 | 12/1975 | United Kingdom . |

*Primary Examiner*—Robert L. Wolfe

*Attorney, Agent, or Firm*—Paul L. DeVerter, II

[57] ABSTRACT

The key comprises a shank and a plurality of bits which are mounted on said shank for limited rotation relative thereto. Each bit has outwardly extending projections for engagement with the tumblers of a lock. The lock comprises a case provided with an axially extending groove. A rotor is rotatably mounted in the case and is provided with a slot. A plurality of tumblers are mounted in the rotor and each is provided with a notch. A fence member is provided which, when the notches on the tumblers are aligned with the slot, is accommodated within the notches and the rotor, and permits the rotor to be rotated relative to the case. When the notches on the tumblers are not aligned with the slot, the fence member is confined within the groove in the case and the slot, thereby preventing rotation of the rotor relative to the case. Each tumbler is provided with a central aperture to accommodate the shank of the key and is further provided with a notch to accommodate an outwardly extending projection on the key.

20 Claims, 7 Drawing Sheets

CYLINDER LOCK AND KEY WITH ROTATING ELEMENTS

BACKGROUND OF THE INVENTION

This invention relates to a key and a lock which can be opened by said key.

This invention was developed to fill the need for a secure lock and key system for electric meters. As energy costs have risen so has the incidence of meter tampering and customer diversion. The electric meter is the most important element in the utility company's revenue collection system and must be guarded with the utmost security. This invention, although not limited to this application, was developed to fulfill the specific needs of a utility company that must lock many units and have access to all of the units with one key. In a typical application, a large utility company might have 1,000,000 locking units and 1,000 employees who would require access to these units. To have many different key combinations in the system would be impractical, requiring each employee to 17 carry many different keys or limiting the locations that he could access to the particular keys that he possessed. In a large locking system with all of the locking units keyed alike and protecting a valuable asset, the key becomes a valuable commodity which is highly sought after. If the key is easily reproducible, an original will invariably get out and, within a short period of time, will be duplicated many times over; ruining the security of the entire system and making the utility company's substantial monetary investment in security worthless. It is, thus, very important to have a locking system that requires a key which is very difficult to duplicate.

The lock and key systems which have been designed for this application by other individuals have attempted to address the specific problems of the utility company. Examples of such locks are generally shown in U.S. Pat. Nos. 3,714,802 and 4,415,190. These prior locks have failed to provide a system that fills all of the constraints of such a demanding application. While the lock must be secure, it must also be economical to manufacture (a constraint which imposes severe limitations on the features of a product without significant innovation in the design of parts for manufacture). The prior locking systems for this application suffer from several, if not, all of the following limitations: their keying system fails to provide the necessary degree of security; the keys are easily duplicated or there are objects readily available which can be used in place of the key with little or no modification to open the lock; the key serial numbers have no protection from obliteration; the keys are bulky and difficult to carry in a pocket or on a key ring; key operation is cumbersome; different elements of the key wear out, requiring replacement or considerable maintenance, making its use frustrating or impossible; weather adversely affects the lock's internal elements, degrading or inhibiting operation; the lock's protective housing can be overcome or particular elements can be fouled or a common tool can be used to extract the lock from its locking fixture; the key holes are of a size or configuration that hinders clean out in the event of malicious tampering or fouling by insects (there are certain insects that are attracted to the lock holes for nesting sites); the lock size and configuration prevents interchangeability with the majority of existing locking fixtures.

SUMMARY

There is thus a need for a cylindrical lock, requiring a key that is very difficult to duplicate and resists any other opening means. Further, it is desirable that it be weather resistant, tamper resistant, the key hole be easy to clean out, the key be of a practical size which can be carried on a common key ring, the key serial number be protected from obliteration, the lock be of a size and configuration to fit in existing locking fixtures and that these constraints be filled in a design for the lock which is practical to manufacture and hence economically competitive. There is also a need to provide a suitable key for such a lock.

The present invention attempts, at least in its preferred embodiments, to satisfy at least some of these needs.

In general, the invention provides a lock with a plurality of rotating disk tumblers and a cylindrical key aperture to receive a cylindrical key which sets these tumblers, said key having a plurality of rotating bits with interlocking means, herein shown as external radial projections, to non-rotatably couple them with their corresponding tumbler and whose rotation is controlled by the interaction of an internal tang on the bit with a shoulder on the shank of the key about which they rotate.

Another aspect of the invention provides a key which comprises a shank and a plurality of bits mounted on said shank for limited rotation relative thereto, each of said bits having interlocking means, herein shown as an outwardly extending projection, for engagement with the tumblers of a lock.

The preferred embodiment embodies a cylindrical lock with a plurality of rotating disk tumblers and a key with rotating elements to operate the lock. The rotating tumblers are contained in a rotating cylinder or "rotor" which in turn is contained by an outer case. The rotor controls the annular position of the locking element.

Control of the movement of the rotor relative to the case controls the locking action. A fence member axially interposed between the rotor and case, with part of its body protruding into a cutout in the rotor wall and part of its body protruding into a slot in the case wall, prevents this relative motion. The fence member bears directly on the edges of the rotating tumblers contained in the rotor and is prevented from further radial penetration by this contact. Each tumbler has a notch in its edge located at a specific annular position dependent upon the specific code. When this notch is aligned with the cutout in the rotor wall it will allow radial penetration of the fence to an extent that the fence will clear the case wall and rotation can occur. Penetration, and thus, rotation can only occur when all of the notches are correctly aligned with the rotor slot and the fence clears the case.

Correct alignment of the tumblers is set by the key. The key is composed of a stack of rotating bits coaxially disposed on a central shaft which is connected to the handle. The shaft has a longitudinal cut with an axial shoulder on each side with a geometry designed to receive tangs which project radially inward on each bit. The tangs are of different widths which determine the amount of rotation that the bits can make on the shaft, and thus, the coding. Each bit in the stack is located so as to correspond to the appropriate tumbler in the lock. When the key is fully inserted in the lock, each key bit aligns in the corresponding plane with the tumbler which it is to rotate and becomes coupled with it such that any rotation that the bit experiences will be transferred to the tumbler.

The key hole is formed by an exterior protective member and the tumbler assembly. The exterior protective member provides an external key aperture while acting to contain the tumbler assembly. The tumblers when assembled form a cylindrical cavity which is created by the alignment of central circular apertures located coaxially in each tumbler and align to form the internal portion of the key aperture in the assembled lock. This aperture is such that correct positioning of the lock tumblers can only be accomplished with a key with movable bits which couple with the tumblers through an appropriate interlocking means, here shown as one or more external radial projections on the bits thus preventing the use of a simpler non-mechanical or non-rotating bit key. The depth of the external key aperture or end cap serves to prevent the use of a non-rotating bit key, since the interlocking means (projections) on the bits must be in line to enter, but out of line in order to rotate the individual tumblers the desired amounts.

This invention can be better understood and other advantages realized by someone skilled in the art by consideration of the drawings and the detailed description of the preferred exemplary embodiment.

BRIEF DESCRIPTION OF THE PREFERRED EMBODIMENT

Figure 1:
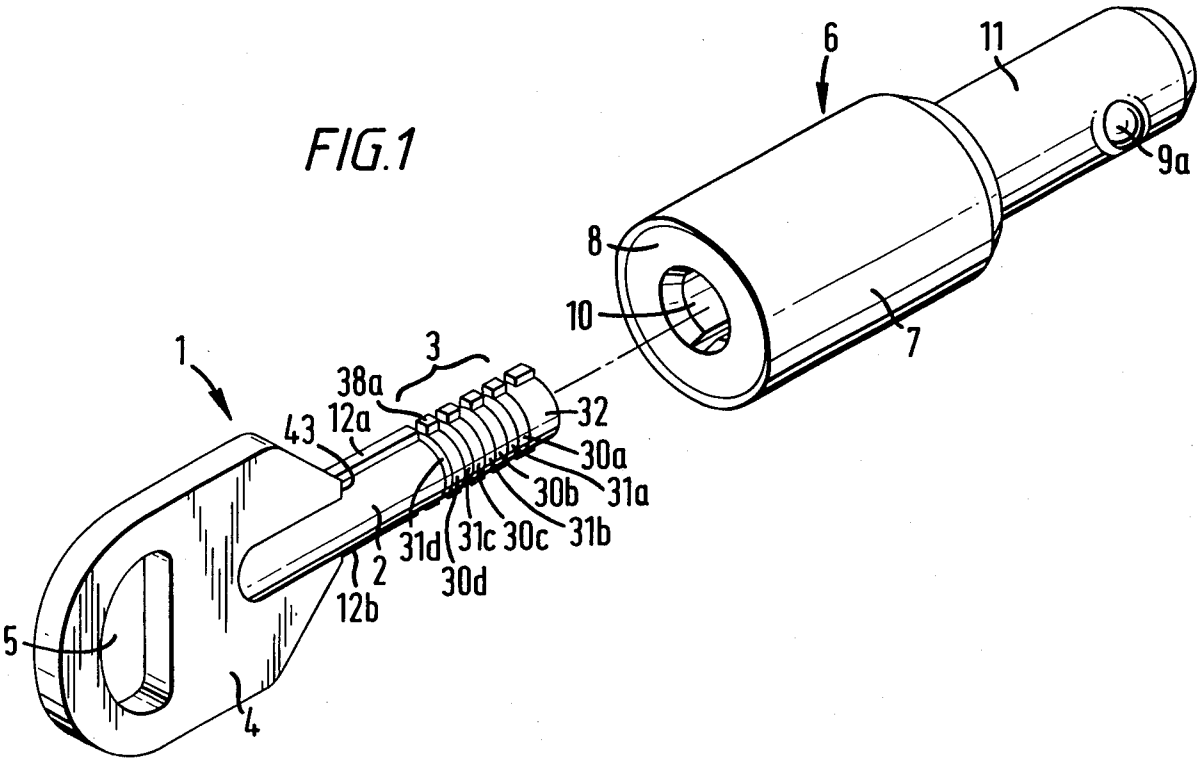
FIG. 1 is an isometric view of a preferred exemplary embodiment of a lock and key in accordance with the present invention; the rotary tumbler lock being installed in a barrel type lock and the key bits shown in an aligned configuration, ready for inserting in the lock.

FIG. 1 depicts a preferred exemplary embodiment of a cylindrical lock and key in accordance with the present invention. The following is a detailed description of these items. Referring to FIG. 1, the exemplary lock, a "barrel lock" is shown generally at 6 with the protective case 7, protective end cap 8, with key aperture 10 and one of two ball bearings *9a* spaced 180 degrees apart in the bolt section 11 of the case. The exemplary key is shown generally at 1 and has shank 2, of which movable bits, shown generally at 3, are a part and to which a handle 4 is attached. A hole 5 is provided in the handle for attachment to a key ring. The key is inserted in an axial direction into the key aperture and is prevented from further penetration by contact between end cap 8 and shoulder 43, depicted in FIG. 1 and FIG. 12. Alternately, penetration could be limited by the contact between base bit 32 FIG. 1 and base guard 20 FIG. 2.

Figure 2:
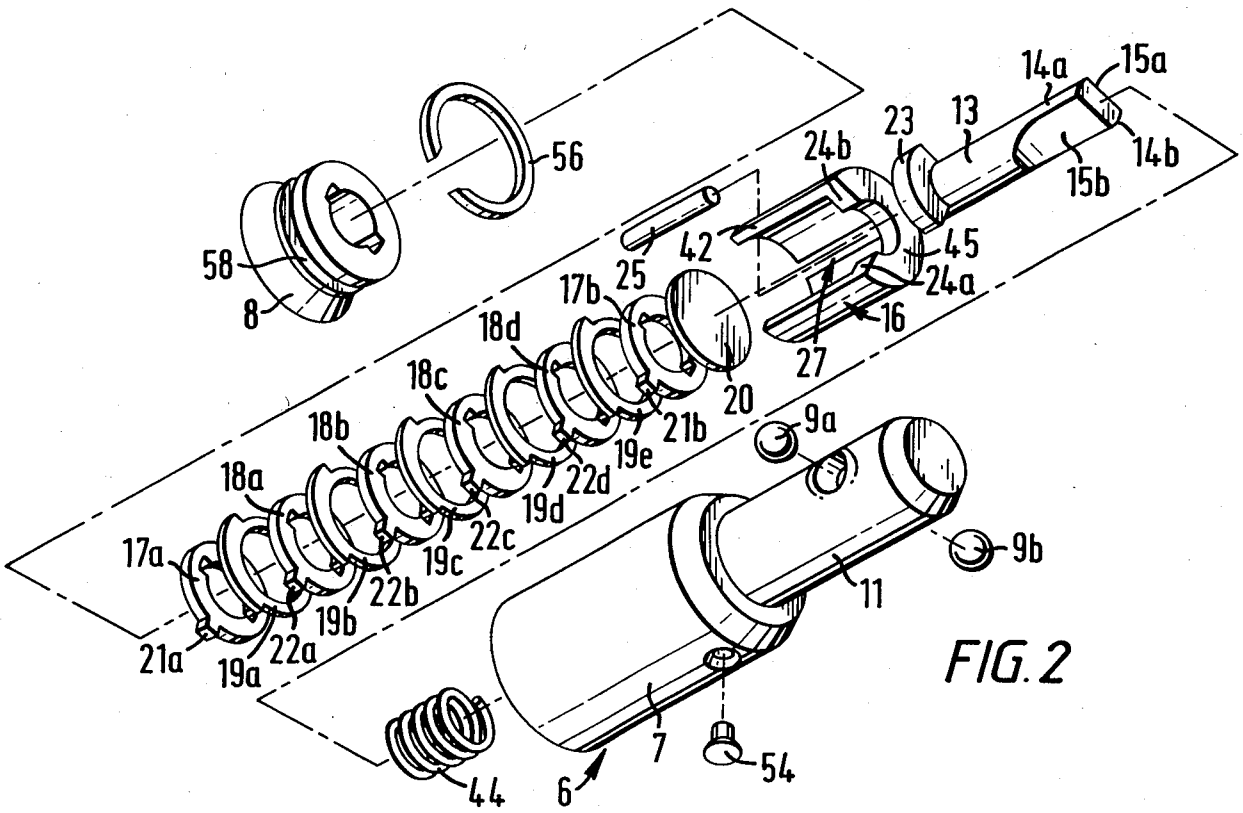
FIG. 2 is an exploded isometric view of the lock shown in FIG. 1 looking from a rearward direction.
Figure 3:
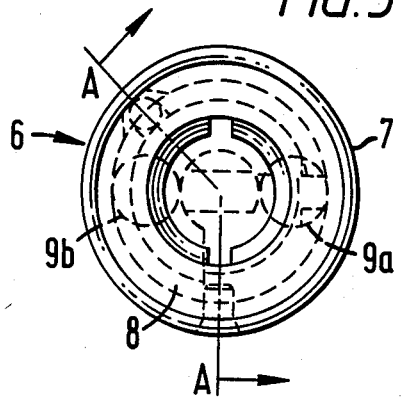
FIG. 3 is a front end view of the lock as shown in FIG. 1.

The barrel lock acts as a pin to prevent opening of whatever device that it is inserted into, such that when the lock is removed the device can be opened. Locking of the device is accomplished by preventing unauthorized removal of the barrel lock. The device to be locked is fitted with a receptacle which is closely fitted to the outside diameter of the barrel bolt section 11 and has internal circumferential grooves or a recess which corresponds to the position of the ball bearings *9a* and *9b* in the case, as can be seen in FIG. 1 and FIG. 2. When the ball bearings are extended the bolt section 11 and the lock cannot be removed. As thus far described, the lock 6 is conventional, and a suitable device to be locked is shown in U.S. Pat. No. 4,415,190.

Figure 4:
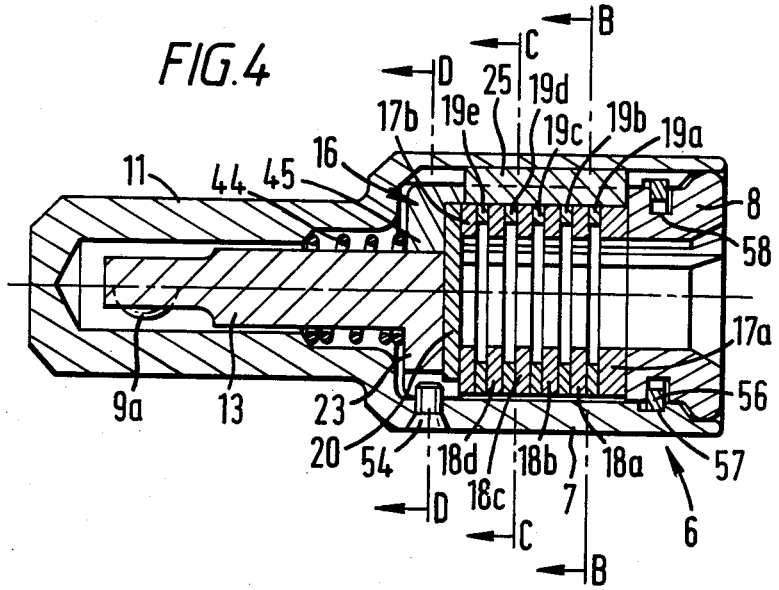
FIG. 4 is a sectional view of the lock as shown in FIG. 1 with the section taken along the surface A—A as shown in FIG. 3.

Referring to FIG. 2 and FIG. 4, the ball bearings project past the case walls when they are extended by the rotor stem 13. When assembled and in the locked configuration ball bearings *9a* and *9b* bear against the rotor stem at *14a* and *14b*. When the rotor stem is rotated clockwise 90 degrees relative to the case the flats on the rotor stem *15a* and *15b* align with the balls and make room for the balls to be cammed inward, thereby reducing the effective diameter of the bolt section 11, and allowing removal.

Control of the movement of the rotor 16 relative to the case controls the extension of the ball bearings and thus the locking action. The tumbler stack composed of: top tumbler *17a;* base tumbler *17b;* code tumblers *18a* through *18d;* spacers *19a* through *19e;* and base guard 20, is inserted in the rotor 16 as shown in FIG. 2 and FIG. 4. The rotor stem 13 is inserted in the rotor and is non-rotatably coupled to it. The abutment of the head 23 on the rotor stem and the surfaces on the cut-out section of the rotor *24a* and *24b* prevent this rotation, thus the rotor stem can only be rotated relative to the case when the rotor is rotated in the same manner. The rotor 16 and rotor stem 13 could be made out of a single piece of material. However the 90° cut-out shown has certain advantages. First, it acts to couple the rotor and rotor stem. Second, the cut-out and stop tab 21 limits rotation of the tumblers, and finally, it limits rotation of the rotor, in conjunction with pin 54, all as hereafter described.

Referring to FIG. 2 and FIG. 4, proper coupling between the rotor stem head and the rotor is ensured by spring 44 which is fitted coaxially on the rotor stem. This coaxial arrangement helps ensure proper alignment between the two parts during assembly. The spring contacts rotor stem head 23 and rotor base 45 maintaining alignment of the rotor base and rotor stem head while, at the same time, applying pressure to the tumbler stack. This pressure increases friction between the tumblers and helps prevent unwanted rotation of the tumblers during key operation.

Figure 5:
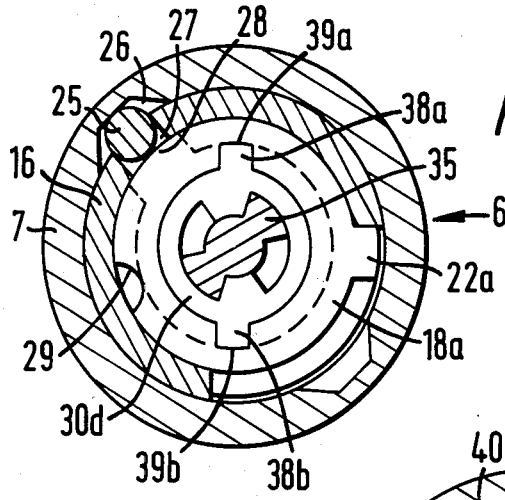
FIG. 5 is a sectional view of the lock as shown in FIG. 1 with the section taken along the plane B—B as shown in FIG. 4 and a sectional view of the key as it would appear inserted in the lock at the center of the assembly. The lock is in a fully locked configuration.
Figure 10:
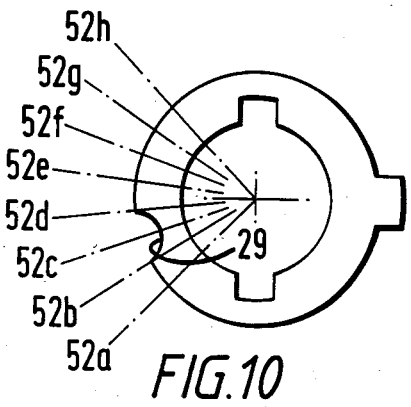
FIG. 10 is a plan view of a code tumbler.

Referring to FIG. 5, a fence member 25 axially interposed between the rotor and case with half of its body protruding into a cut-out 27 in the rotor 16 and half of its body protruding into a slot in the case wall 26, prevents relative motion of the rotor 16 and rotor stem 13 assembly relative to the case. The fence member bears directly on the edges at 28 of the rotating tumblers contained in the rotor and is prevented from further radial penetration by this contact. Each tumbler has a notch in its edge, such as 29, located at a specific angular position relative to the stop tab, such as 22*a*, and dependent upon the specific code of the given tumbler. FIG. 10 shows eight possible locations (and thus tumbler codes) for the notch in the code tumbler. These locations are indicated by construction lines 52*a* through 52*h*; the location of the notch shown is 52*c*. When this notch is aligned with the cut-out in the rotor wall it will allow radial penetration of the fence to an extent that the fence will clear the case wall and rotation can occur, see FIG. 7. Penetration, and thus rotation, can only occur when all of the notches are correctly aligned with the rotor slot and the fence clears the case.

Figure 9:
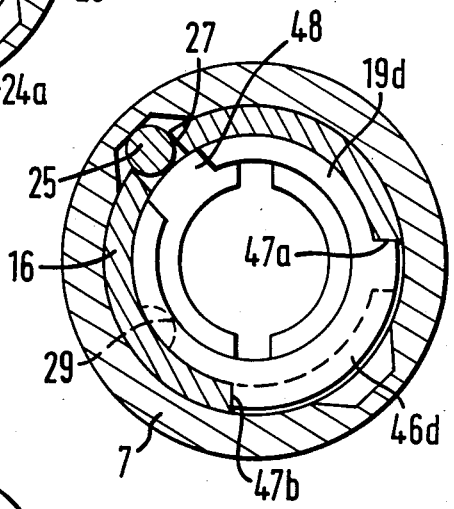
FIG. 9 is a sectional view of the lock as shown in FIG. 1 with the section taken along the plane C—C as shown in FIG. 4.

FIG. 2 shows the placement of the spacers 19*a* through 19*e* which act to prevent the transfer of rotation between the individual tumblers. Referring to FIG. 9, the spacers are prevented from rotating relative to the rotor by webs, such as 46*d*, which contact the cut-out of the rotor at 47*a* and 47*b* and have gaps like 48 to allow penetration of the fence 25 when the tumbler notches are in the aligned position.

Referring to FIG. 2, base guard 20 fits at the base of the stack in the rotor 16 and is free to rotate. The base guard is made of a hard material and is designed to prevent drilling. If an attempt were made to drill out the base of the lock through the key aperture the drill would contact the base guard first, which would in turn, spin freely and fail to supply the counter torque required to drill through it.

The spacers, base guard, and tumblers are held in the rotor 16 by means of the end cap 8 and the snap ring 56 which fits in the internal groove 58, and expands into groove 57 of the rotor, as seen in FIG. 4. Once assembled, it is virtually impossible to disassemble the lock without destroying the case 7.

Figure 11:
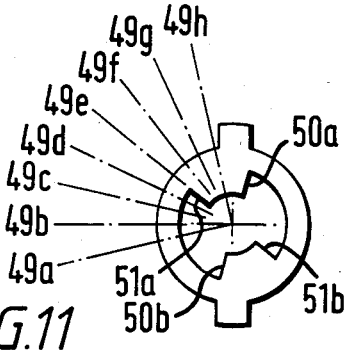
FIG. 11 is a plan view of a key bit.
Figure 12:
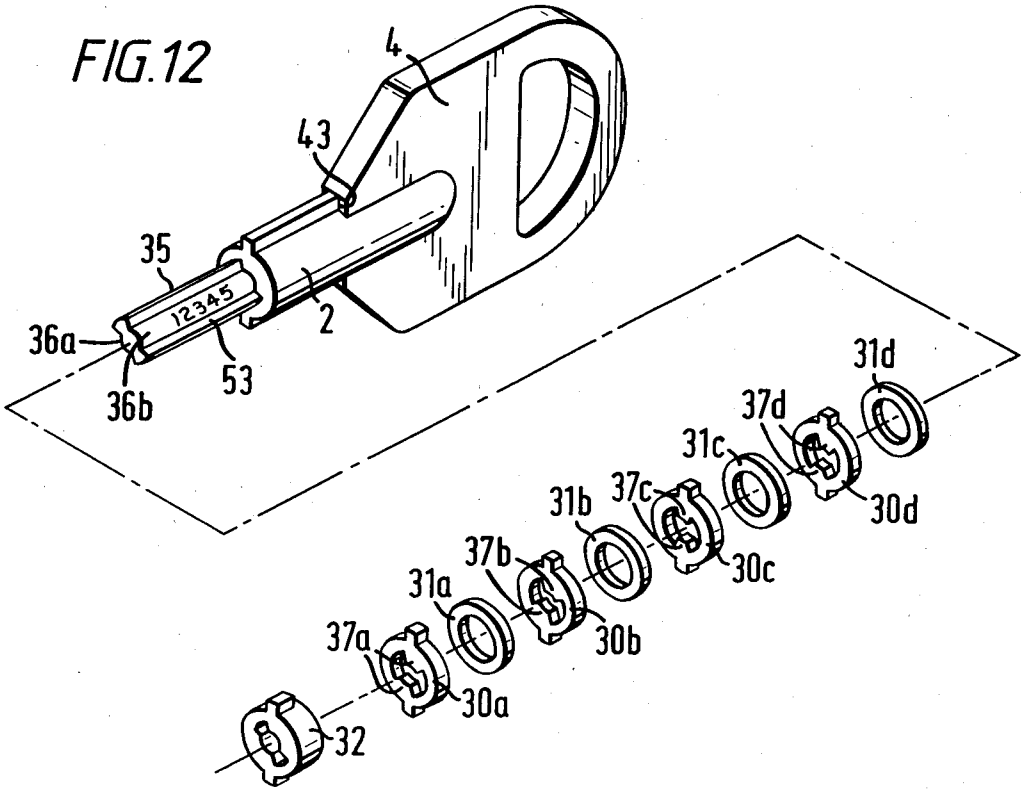
FIG. 12 is an exploded isometric view of the key shown in FIG. 1.

Correct alignment of the tumblers is set by the key. Referring to FIG. 12 the key is composed of a stack of rotating bits 30*a* through 30*d* separated by spacers 31*a* through 31*d*, coaxially disposed on a central shaft 35 and captivated on this shaft by a base bit 32 which is permanently attached to the shaft as shown in FIG. 1. Referring again to FIG. 12, the shaft 35 is an integral part of the shank 2 which is connected to the handle as described earlier. The shaft 35 has a full length longitudinal cut with axial shoulder 36*a* and 36*b* on each side, with a geometry designed to receive tangs shown generally at locations 37*a* through 37*d* which project radially inward on each bit. There are two identical tangs on each bit whose widths are dependent upon the code for that bit. The tangs on different bits may be of different widths. The width of the tang determines the amount of rotation that each bit can make on the shaft and thus the coding. FIG. 11 shows eight possible tang widths which are indicated by construction lines 49*a* through 49*h*; the bit shown has a tang width corresponding to position 49*a*. The shoulders 50*a* and 50*b*, FIG. 11 retain the same position as illustrated for every code and shoulders 51*a* and 51*b* are changed to render the different codes. Each bit in the stack is located axially so as to correspond to the appropriate tumbler which it is to rotate. Referring to FIG. 5, in this embodiment the key bits and tumblers become coupled in the same manner as illustrated by bit 30*d* and tumbler 18*a* in FIG. 5 by means of engagement of two radial external projections 38*a* and 38*b* on the key bits, with two corresponding notches 39*a* and 39*b* in the corresponding tumbler. Thus, any rotation that the bit experiences will be transferred to the tumbler.

However, it should be noted that other geometric shapes could be used to interlock the bits and tumblers so as to transfer the rotation desired. For example, the notches could be in the bits and the projections on the tumblers; or the bits could be triangular externally and the tumblers matching internally, the object being to provide interlocking means to transmit a certain angular rotation to the tumblers by the bits.

The serial number of the key is placed, non-removably, on the key shaft generally at 53 as shown in FIG. 12 and, in this illustration bears the value "12345". By placing the serial number in this position the key bit and spacer stack shield it from access. Anyone desiring to destroy the serial number would have to dismantle the key to gain access to the number; dismantling the key without destroying its functionality would be very difficult and highly unlikely.

Figure 6:
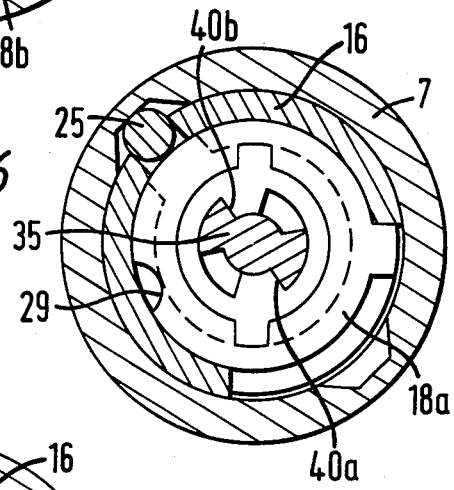
FIG. 6 is a sectional view of the lock as described in FIG. 5 with the key center shaft rotated to the point that it just picks up the key bit.

Operation of the lock is as follows: Referring to FIG. 1, the key is initially configured such that all bits are rotated to align their radial projections, such as 38*a*, with the splines 12*a* and 12*b* on the key shank. Next, the key is inserted in the lock in an axial direction as shown in FIG. 1. Just after insertion, the tumbler stack is turned by the key, counter clockwise until tumbler tabs 21*a*, 21*b* and 22*a* through 22*d* contact the rotor edge 42 as can be seen in FIG. 2, placing the tumblers in initial alignment ready to be set, such as the configuration shown in FIG. 5. The key is next rotated in a clockwise direction as viewed from the insertion side of the lock. The key sets each of the lock tumblers in an analogous manner to that shown in FIG. 5 through FIG. 7 by tumbler 18*a* and key assembly composed of bit 30*d* and shaft 35. During rotation the key shaft 35 turns leaving the key bit 30*d* and its corresponding tumbler 18*a* stationary until the shoulders of the longitudinal cuts 36 on the shaft contact the internal tangs on the bit at 40*a* and 40*b* as shown in FIG. 6. At this point the bit and tumbler become engaged with the key shaft and begin to rotate with it.

Full key shaft rotation is constrained to 90 degrees relative to the rotor by tabs 21*a* and 21*b* on top tumbler 17*a* and bottom tumbler 17*b*, FIG. 2. The key shaft is non-rotatably coupled to these tumblers through the key shank 2 and base bit 32 (FIG. 1) respectively with which they align upon full insertion of the key. This constraint provides a repeatable path of rotation relative to the rotor for the key shaft to follow each time the lock is operated. With this repeatability it can be assured that the bits and tumblers will be picked up at the appropriate angular position relative to the rotor and then be rotated with the shaft through the remainder of its path.

Figure 7:
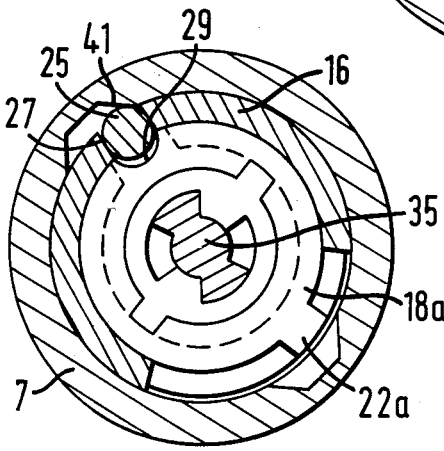
FIG. 7 is a sectional view of the lock as shown in FIG. 5 with the key center shaft, key bit and lock tumbler rotated to the unlocked position.
Figure 8:
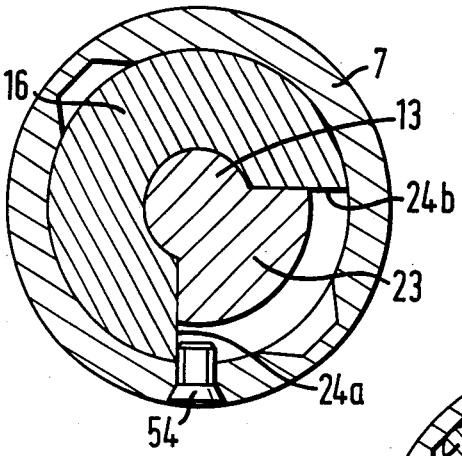
FIG. 8 is a sectional view of the lock as shown in FIG. 1 with the section taken along the plane D—D as shown in FIG. 4.

Once the key shaft has completed its rotation each tumbler will have been rotated to place its notch in alignment with the slot in the rotor wall as demonstrated in FIG. 7 by notch 29 and slot 27. Upon arriving at this position the key cannot rotate any further relative to the rotor and thus exerts a torque on the rotor assembly forcing fence 25 against case slot wall 41 which tends to cam the fence into the notch 29, ultimately allowing the fence to clear the case wall, decoupling the rotor from the case and allowing rotation of the rotor and rotor stem. This rotation is limited to 90 degrees relative to the case, as can be seen in FIG. 8, by groove pin 54 which hits the rotor cut-out area at **24*a* and 24*b* allowing rotation of the rotor, rotor stem assembly to stop exactly at a position which aligns the rotor stem flats 15*a* and 15*b* with the ball bearings 9*a* and 9*b* as seen in FIG. 2**. This alignment allows retraction of the ball bearings thus placing the lock in a full open configuration, and allowing axial removal of the bolt from the device being unlocked.

The key described herein is useful with other kinds of locks besides the barrel lock configuration. The rotary motion of the rotor could be used to engage or disengage other locking mechanisms including, for example, a padlock shackle or a sliding bolt. This number of tumblers and bits may, within reason, be increased or decreased. The spacers and tumblers may be of different thicknesses, so long as the corresponding bits and tumblers interlock properly. The depth of the end cap ordinarily must be at least the distance between the far sides of any two adjacent bits, in order to ensure that non-rotatable bit keys will not be useful.

The present invention, therefore, is well adapted to carry out the objects and attain the ends and advantages mentioned, as well as others inherent therein. While the presently preferred embodiment of the invention has been given for the purposes of disclosure, numerous changes in the details of construction, and the combination, shape, size, and arrangement of the parts and uses may be resorted to without departing from the spirit and scope of the invention.

What is claimed is:

1. A key for use with a lock having at least one tumbler therein, comprising:

(a) a handle, (b) a generally cylindrical shank extending from the handle, (c) at least one bit rotatably mounted on and coaxial with the axis of the shank;

(d) internal means for limting the degree of rotation of the bit relative to the shank, located at the interface between the shank and bit, (e) the bits remaining free to rotate relative to the shank, within preset limits, when the key is inserted in the lock, and (f) means for interlocking the rotation of the bit to the tumbler of the lock.

2. A key for use with the lock having a plurality of axially spaced, rotatable tumblers therein, comprising:

(a) a handle, (b) a generally cylindrical shank extending from the handle, (c) a plurality of bits, matching the number of tumblers, rotatably mounted on and coaxial with the axis of the shank, (d) rotation limiting means limiting the degree of rotation of each bit relative to the shank, located internally at the interface between the shank and the bit, (e) spacers between the bits conforming the axial spacing of the bits along the shank to the axial spacing of the tumblers, (f) interlocking means coupling the rotation of each bit to the tumbler with which matched, and (g) retaining means maintaining the rotatable bits on the shank, and maintaining the bits free to rotate relative to the shank, within preset limits, when the key is inserted in the lock.

3. The invention of claim 2 wherein the rotation limiting means includes:

(a) a longitudinal cut having shoulders along the shank of the key, and (b) a tab on the bit extending into the cut and engaging the shoulders upon a predetermined rotation of the shank within the bit.

4. The invention of claim 2 wherein the interconnecting means includes:

(a) a projection on one of the bit and tumbler, and (b) a notch, mateable with the projection on the other of the bit and tumbler, thereby coupling rotation of the bit to the tumbler.

5. The invention of claim 2 wherein the retaining means comprises a base bit, located on the end of the shank opposite the handle, similar in external shape to the rotatable bits, but non-rotatably fixed to the shank.

6. A lock which can be opened by a key according to claim 2.

7. A cylinder lock comprising a case provided with an axially extending groove, a rotor rotatably mounted in said case and provided with a slot, a plurality of tumblers mounted in said rotor and each provided with a notch, a fence member which, when the notches on said tumblers are aligned with said slot is accommodated within said notches and said rotor and permits said rotor to be rotated relative to said case, and which, when the notches on said tumbler are not aligned with said slot, is confined within said groove in said case and said slot thereby preventing said rotor being rotated relative to said case, said tumblers each being provided with a central aperture to accommodate the shank of a key and being further provided with radially outwardly extending notches from the central aperture to couple with outwardly extending projections on the bits of said key.

8. The invention of claim 7 including a base guard rotatably mounted in said rotor remote from the entrance end of said lock.

9. The invention of claim 7 including a plurality of spacers mounted intermediate said tumblers.

10. The invention of claim 7 wherein part of the side wall of said rotor is cut away and said tumblers are provided with tabs whose engagement with the side of said rotor limit the rotational movement of said tumblers.

11. A cylinder lock comprising:

(a) a case, (b) a rotor rotatably mounted within the case, (c) a rotor stem coupled to the rotor, (d) the rotor stem being rotatable through a certain arc relative to the case, (e) the lock being unlocked when the stem is rotated to one end of the arc and locked when rotated to the other end of the arc, (f) the case having an axially extending groove therein adjacent the rotor, (g) the rotor having an axially extending slot thereon aligned with and adjacent to the case groove when the lock is locked, (h) a fence extending within the slot, (i) the fence positioned partially within the slot and within the groove when the slot and groove are aligned, thereby preventing relative rotation of the rotor with the case, (j) a plurality of rotatable tumblers mounted axially within the rotor, (k) each tumbler having a notch in its edge, sized to accommodate the fence when rotated adjacent thereto, (l) the fence arranged to cam out of the groove and be positioned partially within the slot and the notches when the tumblers are rotated to align the notches with the slot, thereby freeing the rotor to rotate freely relative to the case, (m) a key having a plurality of bits corresponding to the number of tumblers, (n) the bits rotatable to various predetermined positions on the key, (o) each tumbler having an aperture therethrough, and (p) means interlocking the tumblers with the bits through the apertures, whereby rotation of the key rotates the tumblers the desired degree to lock and unlock the lock.

12. A key for use with a lock having at least two tumblers therein, comprising:

(a) a handle, (b) a generally cylindrical shank extending from the handle, (c) at least one fixed bit mounted on and coaxial with the axis of the shank, (d) at least one bit rotatbly mounted on and coaxial with the axis of the shank, (e) internal means limiting the degree of rotation of the rotatable bit relative to the shank, located at the interface between the shank and bit, (f) the rotatable bit being rotated, relative to the shank, to a first position in line with the fixed bit for insertion into the lock, (g) the rotatable bit being rotated to a second position, relative to the shank, after being inserted into the lock, and (h) interlocking coupling means for transferring rotation of the fixed bit and the rotatable bit when in the second position to the tumblers of the lock.

13. The invention of claim 12 wherein the internal means limiting the degree of rotation of the rotatable bit includes:

(a) a longitudinal cut having shoulders along the shank of the key, and (b) a tab on the bit extending into the cut and engaging the shoulders upon a predetermiend rotation of the shank within the bit.

14. A cylinder lock to be opened by a key having bits which are rotatable to various pre-determined positions when in the lock, comprising:

(a) an elongate case, (b) a rotor rotatably mounted within the case, (c) a rotor stem coupled to the rotor, (d) means limiting rotation of the rotor relative to the case to a predetermined arc, (e) the lock being unlocked when the stem is rotated to one end of the arc, and locked when rotated to the other end of the arc, (f) a plurality of rotatable tumblers mounted axially within the rotor, (g) fence means preventing relative rotation of the rotor to the case when the outer peripheries of the tumblers are aligned in a first positon, and releasing the rotor to rotate freely relative to the case when the outer peripheries of the tumblers are aligned in a second position, (h) each tumbler having an identical non-circular aperture therethrough, whereby each tumbler may be rotated from the first to the second position, (i) an end cap rotatably mounted in the entrance end of the case, and maintaining the rotor and tumblers within the case, (j) the end cap having a non-circular aperture therethrough, identical to the aperture in the tumblers, (k) the depth of the end cap being at least as great as the distance between the far sides of any two adjacent tumblers; and (l) interlocking coupling means for transferring rotation of a key inserted into the non-circular apertures to the tumblers and end cap.

15. In the invention of claim 14 including a base guard rotatably mounted in said rotor, remote from the entrance end of the lock.

16. The invention of claim 14 including a plurality of spacers mounted intermediate the tumblers.

17. The invention of claim 16 including spring means yieldingly urging the tumblers against the end cap.

18. The invention of claim 14 wherein part of the sideiwall of said rotor is cut away and said tumblers are provided with tabs whose engagement with the side of the rotor limit the rotational movement of said tumblers.

19. The invention of claim 14 wherein the means limiting rotation of the rotor includes:

(a) an arcuate cut-out portion located on the circumference of the rotor, and (b) a stop mounted on the case, extending into the cut-out portion of the rotor, whereby the rotor is only rotatable within the case through a pre-determined arc.

20. In a cylinder lock of the type having a generally cylindrical bore, a rotor within the bore, at least one tumbler rotatably mounted in the rotor, and means for rotating the rotor in the case in a pre-determined arc, the improvement comprising:

(a) the rotor being generally cup shaped, (b) a rotor stem within the case located adjacent the bottom of the cup shaped rotor, (c) the lock being unlocked when the stem is rotated to a first position, and locked when rotated to a second position, (d) an arcuate portion cut out of the rotor extending through the bottom and along the side wall, (e) the rotor stem having a head fitting into the arcuate cut out portion of the bottom of the rotor, whereby rotation of the rotor is coupled to the stem, (f) a stop mounted on the case, extending into the cut out portion of the rotor, whereby the rotor is only rotatable within the case through a pre-determined arc, and (g) the tumblers being provided with tabs which engage the sides of the cut out portion of the rotor, whereby the rotation of the tumblers are limited relative to the rotor.

* * * * *